US006036444A

United States Patent [19]

Barney et al.

[11] Patent Number: 6,036,444

[45] Date of Patent: Mar. 14, 2000

[54] PROTECTIVE AIR PASSING SHIELD

[75] Inventors: Brian W. Barney, Morton; Paul J. Byrne, Peoria; Gary L. Heiser, Pekin; Gary E. Philipsen, Peoria, all of Ill.

[73] Assignee: Caterpillar Inc., Peoria, Ill.

[21] Appl. No.: 09/024,851

[22] Filed: Feb. 17, 1998

[51] Int. Cl.[7] ..... F04D 29/70

[52] U.S. Cl. ..... 416/247 R; 416/247 A; 416/121.2

[58] Field of Search ..... 415/247 R, 247 A, 415/121.2

[56] References Cited

U.S. PATENT DOCUMENTS

| | | | |
|---|---|---|---|
| 1,114,459 | 10/1914 | Fritts | 416/247 R |
| 2,100,923 | 11/1937 | Schmidt et al. | 230/273 |
| 2,215,035 | 9/1940 | Gundelfinger | 230/273 |
| 2,544,281 | 3/1951 | Seil | 230/275 |
| 2,656,974 | 10/1953 | Holstein | 230/259 |
| 2,987,242 | 6/1961 | Mazzacane | 230/259 |
| 3,123,288 | 3/1964 | Franklin | 230/273 |
| 3,791,333 | 2/1974 | Losch | 115/34 R |
| 4,818,183 | 4/1989 | Schaefer | 416/247 R |
| 4,861,230 | 8/1989 | Breining | 416/247 R |
| 5,240,378 | 8/1993 | Janisse et al. | 416/247 R |
| 5,348,447 | 9/1994 | Redetzke | 416/247 R |
| 5,460,485 | 10/1995 | Sugiyama et al. | 415/208.2 |

*Primary Examiner*—Edward K. Look
*Assistant Examiner*—Rhonda Barton
*Attorney, Agent, or Firm*—Alan J. Hickman

[57] ABSTRACT

A protective air passing shield has a top shield resiliently releasably connected by a plurality of mounts to an end portion of a side shield. The protective air passing shield is disposed about a fan and connected to a shroud of a cooling system and blocks large particles from the cooling system.

19 Claims, 3 Drawing Sheets

PROTECTIVE AIR PASSING SHIELD

TECHNICAL FIELD

This invention relates generally to a fan guard assembly and more particularly to a protective air passing shield having a top shield and side shield connected by a plurality of mounts.

BACKGROUND ART

Fan guard cracking is becoming more of a problem. Having work machines designed to provide more horsepower requires a cooling systems that utilize larger components, for example, fans, blades, drive belts, and the like in order to provide adequate cooling. Operation of fans and/or work machines induced stresses (vibrational) into fan guards at such a level that cracking of conventional fan guards occur. Pieces from the cracked fan guards may be propelled into the components of the cooling system, for example a radiator, and cause cooling leaks. This results in engine overheating, premature engine wear, and poor engine performance.

Various mounting techniques have been developed in an attempt to absorb motor and fan vibrations. For example, U.S. Pat. No. 2,987,242 To Mazzacane, dated Jun. 6, 1961, discloses a resilient fan guard support connected to a rigid panel. The mounts connect the supporting portion of the fan guard to the fan motor in order to isolate the fan guard from the stresses induced by the fan motor. The fan guard of Mazzacane does not address the need for isolating the stresses that are induced by the work machine during operation from the protective air passing shield 10.

Another solution, U.S. Pat. No. 2,656,974 to Holstein, Oct. 27, 1953, discloses a window fan support having a ring for vibration dampening of an electric motor. The ring connects the supporting portion of the fan guard to the fan motor in order to isolate the fan guard from the stresses induced by the fan motor. The fan support of Holstein does not address the need to isolate the stresses induced by the work machine during operation. In either case, the above are for applications where the supporting portion is rigid, such as a wall.

Today machine designs emphasize smaller engine compartments while demanding an increase in engine power. This emphasis requires the cooling system to fit into a smaller space within the engine compartment. Having reduced space makes it harder to service the fan and belts for maintenance and/or repair. Typically a one piece fan guard is provided. One piece fan guards make it difficult to check and remove the cooling system components, for example, fans, belts, and alike. A one piece fan guard covering the fan blades is difficult to unfasten and remove from the engine compartment.

The present invention is directed to overcoming one or more of the problems as set forth above.

DISCLOSURE OF THE INVENTION

A protective air passing shield for a cooling fan comprises a side shield having an end portion, a top shield that is positioned about the end portion of the side shield, and a plurality of mounts releasably fastening the top shield and the side shield.

BEST MODE FOR CARRYING OUT THE INVENTION

Figure 1:
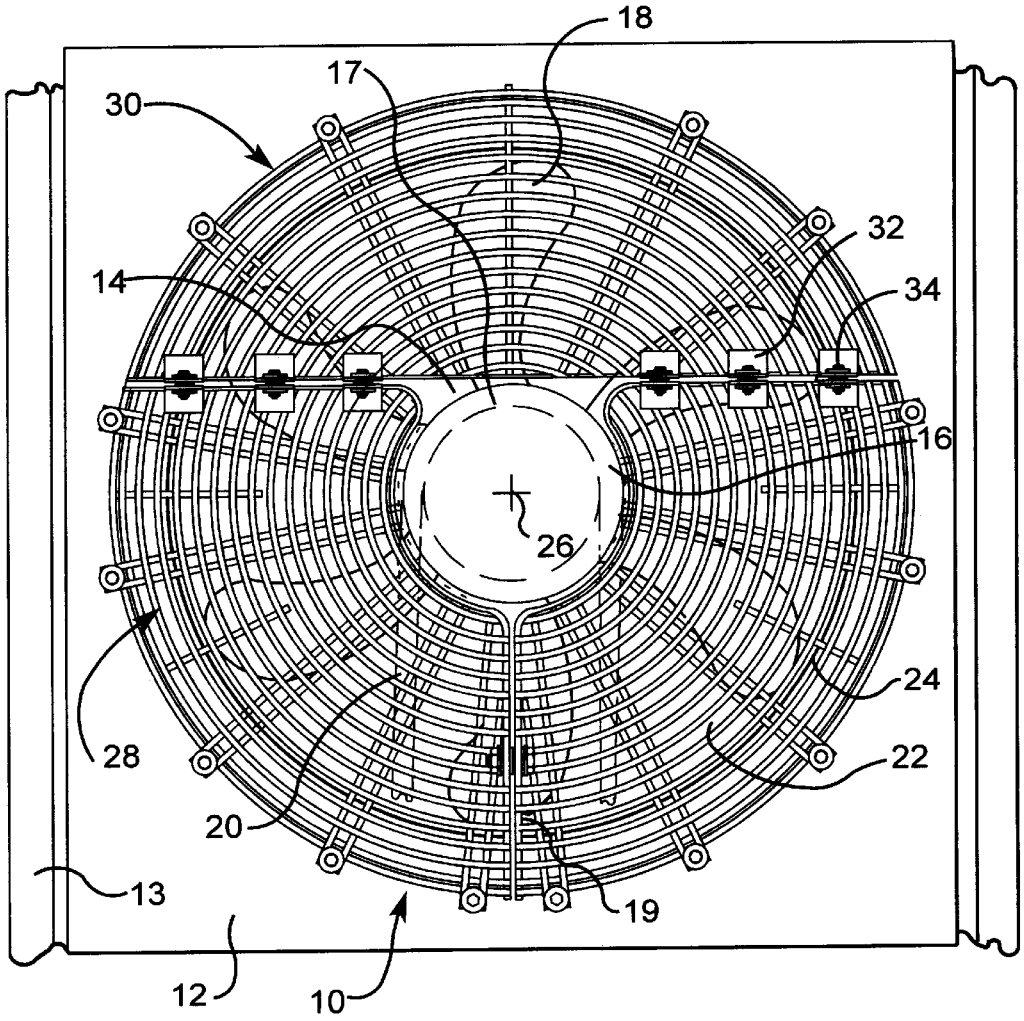
FIG. 1 is a diagrammatic front plan view of a protective air passing shield.
Figure 2:
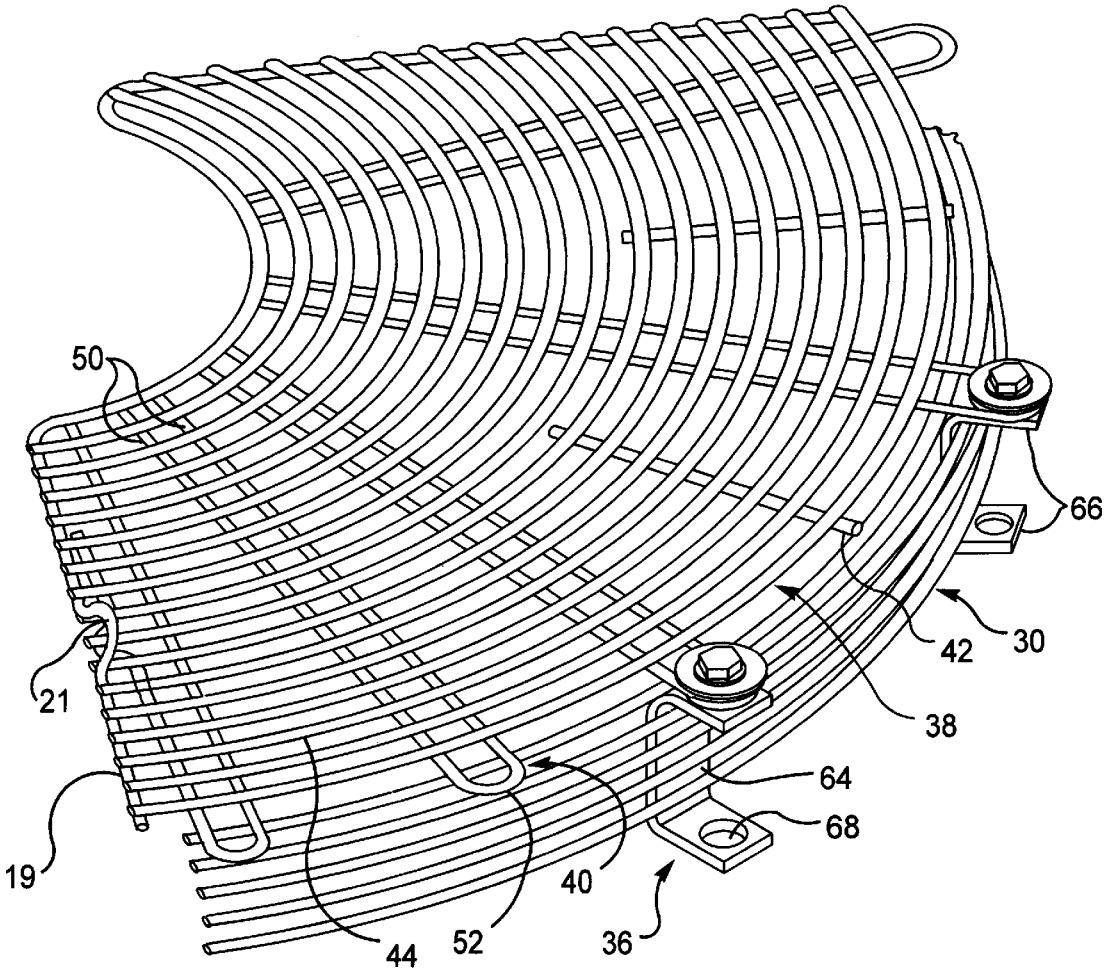
FIG. 2 is a diagrammatic exploded partial view of a portion of the protective air passing shield of FIG. 1 embodying the present invention.

Referring to FIG. 1, a front plan view of a protective air passing shield 10 for using in a work machine, for example, wheel loader, back hoe loader, material handler, off highway trucks, tractors, machines, industrial engines, power generation, and the like is shown. A protective air passing shield 10 is shown attached to a shroud 12 that is secured to an engine frame 13. A fan 14 has a hub 16 and a plurality of spaced fan blades 18 connected to the hub 16. The hub 16 is connected to a fan drive pulley 17. The fan drive pulley 17 is driven in a conventional manner by a drive belt 20 rotated by an engine driven drive pulley (not shown). The shroud 12 has an opening 22 of a predetermined size disposed therethrough. The opening 22 is defined by a generally cylindrical surface 24 and a longitudinal axis 26 as best seen in FIG. 2. The opening 22 is of a predetermined size sufficient to receive the plurality of spaced fan blades 18. The protective air passing shield 10 has a top shield 28 and a side shield 30 which will be discussed later in detail. The top shield 28 may be segmented and attached one to another to provide easy access to the plurality of spaced fan blades 18 and drive belts 18 for maintenance or replacement. These segments may have a perimeter wire 19 that has a loop 21 for fastening the segments. In this embodiment a plurality of "L" brackets 32 are welded to each segment of the top shield 28. The plurality of "L" brackets 32 are then connected in a conventional manner by a fastener 34. It should be understood that the fastener 34 includes any of mounts, bolts, studs, clips, or the like.

Figure 3:
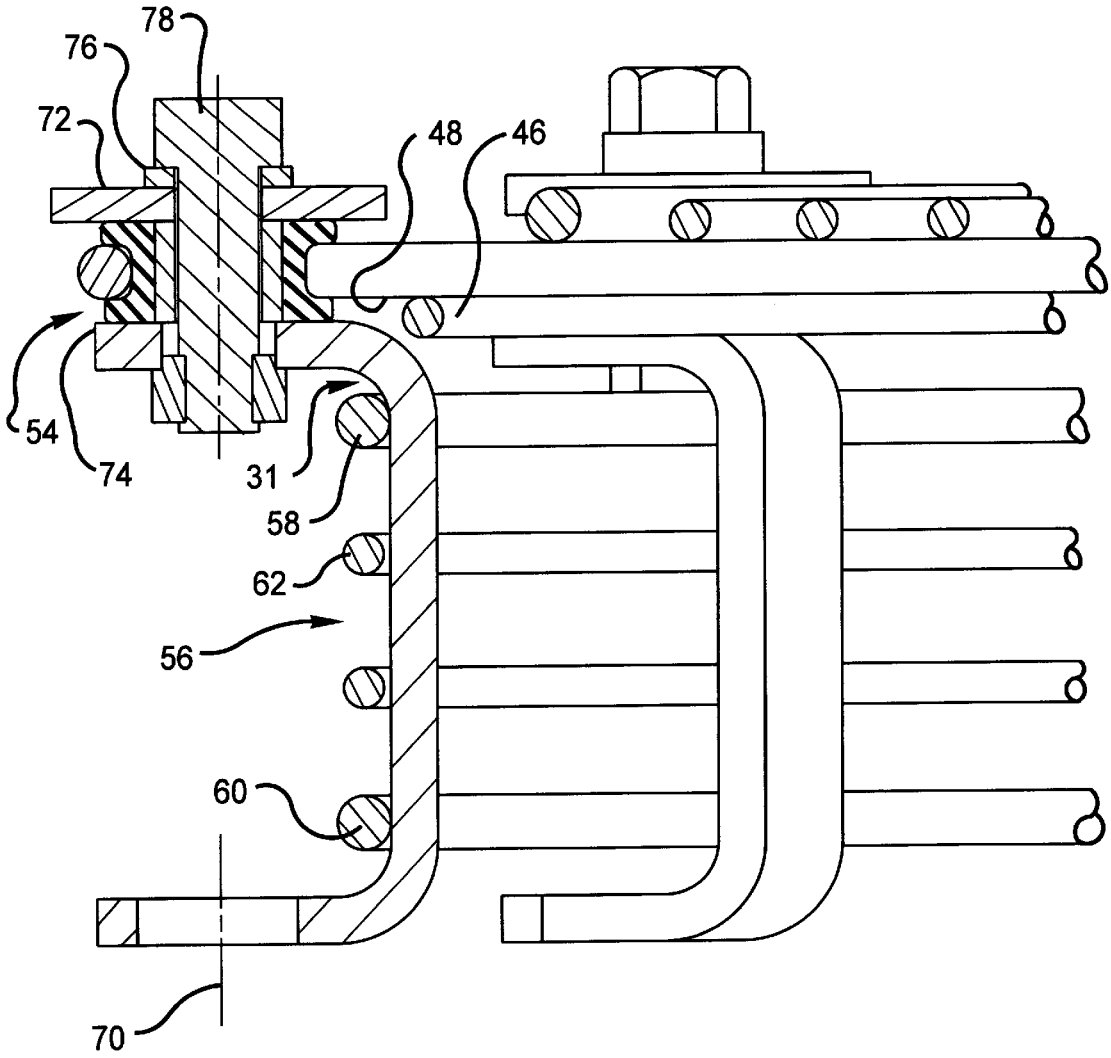
FIG. 3 is a diagrammatic exploded partial view of a portion.

Referring to FIG. 2 and FIG. 3. The top shield 28 and the side shield 30 of the protective air passing shield 10 are shown attached to a plurality of brackets 36. The top shield 28 is positioned about an end portion 31 of the side shield 30. The top shield 28 includes a cage portion 38, a plurality of fastening portions 40, and a plurality of support portions 42. The cage portion 38 has a plurality of spaced wire 44 that provides safety. The plurality of spaced wire 44 is radially disposed about the longitudinal axis 26 of the opening 22 in the shroud 12. The spacing is about 9 mm to 12 mm apart to keep debris from contacting the plurality of spaced fan blades 18. For example, hoses, clamps, rocks, and alike may cause damage to the plurality of spaced fan blades 18 with a spacing greater than specified. To maintain the desired spacing between the side shield 30 and the cage portion 38 requires an outermost wire 46 that is securely fastened to an opposing side 48 of the plurality of fastening and support portions 40, 42. One example of securely fastening would be welding the outermost wire 46 to the opposing side 48. Having the outermost wire 46 in this location maintains the spacing about 9 mm to 12 mm. The outermost wire 46 is radially spaced from the longitudinal axis 26 of the opening 22. The radial distance is less than the radial distance of the side shield 30.

The plurality of fastening portions 40 have a pair of sides 50 and a pair of ends 52. The pair of sides and ends 50, 52 are generally perpendicular to the longitudinal axis 26. The cage portion 38 is secured to the plurality of fastening portions 40. The pair of ends 52 are used to secure the top shield 28 to the plurality of brackets 36 with a plurality of mounts 54 which will be discussed later in detail. The pair of ends 52 may be curvilinear for engaging the plurality of mounts 54. The plurality of support portions 42 of top shield 30 extend radially and are generally perpinducular to the longitudinal axis 26. The plurality of support portions 42 provide a greater level of rigidity to the cage portion 38. This rigidity is capable of better withstanding of vibrational loads that may be induced into the protective air passing shield 10 from operational characteristics of the fan 14, work machine, and alike.

The side shield 30 being separate from the top shield 28 has a plurality of spaced rings 56. The plurality of spaced rings 56 are radially disposed about and at a predetermined distance from the longitudinal axis 26 of the opening 22. The plurality of spaced rings 56 are spaced between a respective pair of extensions 66 of the plurality of brackets 36. The side shield 30 is securely fastened to the plurality of brackets 36. For example, the plurality of spaced rings 56 of the side shield 30 are welded to the plurality of brackets 36. The plurality of spaced rings 56 have a fist ring 58, a second ring 60, and a plurality of inner rings 62. The stresses may require the protective air passing shield 10 to have first and second rings 58, 60 of a greater thickness than the plurality of inner rings 62. The plurality of inner rings 62 are intermediate the first and second rings 58, 60.

The plurality of brackets 36 have a base portion 64 and a pair of extensions 66. The base portion 64 is generally perpendicular to the longitudinal axis 26 of the opening 22 and has the side shield 30 secured to it. The pair of extensions 66 have a bore 68 that is generally parallel to the longitudinal axis 26 of the opening 22 and are axially aligned with each other. Applications may require that the pair of extensions 66 each defining a longitudinal axis 70 that are generally parallel to one another. Having the pair of extensions 66 as previously described aids in securing the plurality of brackets 36 to the shroud 12 and in securing the top shield 28 to the plurality of brackets 36 by permitting tooling to reach the pair of extensions 66. For example, conventional sockets may be used to fasten the plurality of brackets 36 and the top shield 28.

The plurality of mounts 54, which is best shown in FIG. 3, each has an opening 72 that is disposed therethrough and has an annular groove 74. The opening 72 is for receiving a conventional fastener, such as a washer 76 and bolt 78, and secures the top shield 28 to each of the plurality of mounts 54. The annular groove 74 receives one of the pair of ends 52 of each of the plurality of fastening portions 40. The annular groove 74 of the plurality of mounts 54 provides vibration dampening of the protective air passing shield 10.

INDUSTRIAL APPLICABILITY

With reference to the drawings and in operation, the stresses are reduced in the protective air passing shield 10 which reduces the potential fan debris from being propelled into compartments of the cooling system. Having the top shield 28 and side shield 30 mounted to the plurality of brackets 36 reduces the stresses that are transmitted through the protective air passing shield 10 by using the plurality of mounts 54. Servicing of the drive belts 20 and maintenance of the fan 14 are improved by using the protective air passing shield 10. Having a top shield 28 that is removable from the protective air passing shield 10 aids in servicing of drive belts 20 and maintenance of fan 14.

The plurality of brackets 36 having the side shield 30 attached are fastened to the shroud 12. The plurality of mounts 54 releasably fasten the top shield 28 to the side shield. Each pair of ends 52 of the plurality of fastening portions 40 engage each annular groove 74 of the plurality of mounts 54 and then each bolt 78 is tightened to a predetermined clamping force. Each segmented side shield 30 is fastened together using the plurality of "L" brackets 32.

The invention lessens the potential for cracking of the protective air passing shield 10. Having the top shied portion 28 being relatively flat, the side shield 30 connected to the shroud 12, and the plurality of mounts 54 connecting the top and side shield 28, 30 reduces the vibration in the top shield 28. Machines in operation introduce vibrational stresses through the shroud 12. The protective air passing shield 10 is able to dampen the stresses with the plurality of mounts 54 and thereby maintain a top shield portion 28 that is free from vibration. It is this vibration that causes cracking of the protective air passing shield 10 in previous designs. Reducing the stresses caused by vibration reduces the cracking of the protective air passing shield 10. It is cracked pieces of protective air passing shield 10 that are generally propelled into cooling systems causing leaks.

The described invention not only improves the life of protective air passing shield 10 but also allows designs to optimize the space allocated for engine compartments. The protective air passing shield 10 provides the cooling system in the same or less space and allows for the engine to operate at its rated range. Providing maintenance of the fan 14 and related drive belts 20 is necessary if the engine is to operate at its specified rating. Having the protective air passing shield 10 as described allows a person to easily remove the top shield 28 for required servicing of the drive belts 20 and fan 14. A protective air passing shield 10 that can be lifted out of the smaller engine compartment facilitates components to be placed in closer proximity with the cooling system. The protective air passing shield 10 also provides space for a larger fan 14 to be used while maintaining servicing of the fan 14 and drive belts 20. The larger fan 14 improves cooling and enables the engine to operate at its optimum horsepower.

We claim:

1. A protective air passing shield for a cooling fan, comprising:

a side shield having an end portion;

a top shield being relatively flat, positioned at said end portion of said side shield, and completely removable from said side shield; and a plurality of mounts resiliently releasably fastening said top shield to said end portion of said side shield.

2. The protective air passing shield of claim 1 wherein said side shield having a plurality of axially spaced rings.

3. The protective air passing shield of claim 2 wherein said plurality of spaced rings being curvilinear and having a first ring, a second ring, and a plurality of inner rings, said plurality of inner rings being intermediate said first and second rings.

4. A protective air passing shield for a cooling fan, comprising:

a side shield having an end portion and a plurality of axially spaced rings, said axially spaced rings being curvilinear and having a first ring, a second ring, and a plurality of inner rings, said plurality of inner rings being intermediate said first and second rings, and said plurality of axially spaced rings having an outer ring thickness greater than an inner ring thickness of said plurality of inner rings;

a top shield being positioned at said end portion of said side shield; and a plurality of mounts resiliently releasably fastening said top shield to said end portion of said side shield.

5. The protective air passing shield of claim 1 wherein said top shield having a cage portion, a plurality of fastening portions, and a plurality of support portions.

6. The protective air passing shield of claim 5 wherein said cage portion having a plurality of spaced wire and a perimeter wire.

7. The protective air passing shield of claim 6 wherein said plurality of fastening portions having an end being curvilinear.

8. A protective air passing shield for a cooling fan, comprising:

a side shield having an end portion;

a top shield having a cage portion and said cage portion having a plurality of spaced wire having an outermost wire being securely fastened to an opposing side of said plurality of fastening and support portions and a perimeter wire, a plurality of fastening portions, and a plurality of fastening portions, said top shield being positioned at said end portion of said side shield; and a plurality of mounts resiliently releasably fastening said top shield to said end portion of said side shield.

9. The protective air passing shield of claim 6 wherein said perimeter wire having a loop.

10. A protective air passing shield for a cooling fan, comprising:

a side shield having an end portion;

a top shield having a cage portion, a plurality of fastening portions, and a plurality of fastening portions having a pair of side wires and an end wire, said top shield being positioned at said end portion of said side shield; and a plurality of mounts resiliently releasably fastening said top shield to said end portion of said side shield.

11. The protective air passing shield of claim 6 wherein said plurality of spaced wires being spaced about 9 mm to 12 mm between the outermost wire of the top shield and the first ring of the side shield.

12. The protective air passing shield of claim 1 wherein said top shield being segmented.

13. The protective air passing shield of claim 12 wherein said top shield segments being attached one to another.

14. A protective air passing shield for a cooling fan, comprising:

a side shield having an end portion;

a top shield being positioned at said end portion of said side shield; and a plurality of mounts having an annular groove and resiliently releasably fastening said top shield to said end portion of said side shield.

15. The protective air passing shield of claim 14 wherein the top shield is disposed in said annular groove.

16. A protective air passing shield for a cooling fan, comprising:

a side shield having an end portion;

a top shield being positioned at said end portion of said side shield; and a plurality of mounts resiliently releasably fastening said top shield to said end portion of said side shield, and said plurality of mounts being fastened to a plurality of brackets.

17. The protective air passing shield of claim 16 wherein said plurality of brackets having a base portion and a pair of extensions.

18. The protective air passing shield of claim 17 wherein said pair of extensions having a plurality of bores and said bore being axially aligned.

19. The protective air passing shield of claim 17 wherein said pair of extensions each defining a longitudinal axis being generally parallel to one another.

* * * * *